US007258265B2

(12) United States Patent
Loew

(10) Patent No.: US 7,258,265 B2
(45) Date of Patent: Aug. 21, 2007

(54) POINT OF PURCHASE DISPLAY CARTON

(75) Inventor: Jonathon Loew, East Meadow, NY (US)

(73) Assignee: Design Display Group, Inc., Carlstadt, NJ (US)

( * ) Notice: Subject to any disclaimer, the term of this patent is extended or adjusted under 35 U.S.C. 154(b) by 106 days.

(21) Appl. No.: 10/811,530

(22) Filed: Mar. 29, 2004

(65) Prior Publication Data

US 2005/0109670 A1 May 26, 2005

Related U.S. Application Data

(60) Provisional application No. 60/458,725, filed on Mar. 28, 2003.

(51) Int. Cl.
*B65D 25/54* (2006.01)
*B65D 19/00* (2006.01)

(52) U.S. Cl. ..... 229/122.22; 40/312; 229/162.1; 229/164

(58) Field of Classification Search ..... 229/122.22, 229/162.1, 164; 206/769, 771, 736, 775; 40/312, 661; 220/662
See application file for complete search history.

(56) References Cited

U.S. PATENT DOCUMENTS 1,114,042 A * 10/1914 Richardson ..... 229/162.1
2,490,779 A * 12/1949 Butcher ..... 229/122.22
2,528,016 A * 10/1950 Smith ..... 229/162.1
2,717,073 A * 9/1955 Young ..... 229/162.1
2,776,083 A * 1/1957 Derman ..... 229/162.1
2,778,487 A * 1/1957 Raeburn ..... 229/162.1
2,941,670 A * 6/1960 Fagan et al. ..... 229/101
2,989,226 A * 6/1961 Swartz ..... 229/122.22
3,193,108 A * 7/1965 Johnson ..... 229/164
3,231,077 A * 1/1966 Grimm ..... 229/162.6
3,417,909 A * 12/1968 Stern ..... 229/122.22
3,487,991 A * 1/1970 Stern ..... 229/122.22
3,608,705 A * 9/1971 Moshel ..... 229/122.22
3,664,494 A * 5/1972 Mergens ..... 229/164
3,912,158 A * 10/1975 Taub ..... 40/312
3,935,943 A * 2/1976 Meyer et al. ..... 229/122.22
4,482,074 A * 11/1984 Lalley ..... 229/122.22
4,741,435 A * 5/1988 Clarke ..... 229/162.1
4,756,409 A * 7/1988 Murray ..... 40/312
4,998,615 A * 3/1991 Bryan ..... 229/164
5,636,746 A * 6/1997 McQueeny ..... 206/769
5,743,403 A * 4/1998 Crysdale ..... 206/482
6,427,907 B1 * 8/2002 Espinoza et al. ..... 229/162.1
6,431,364 B1 * 8/2002 Saladyga ..... 40/312
6,442,879 B1 * 9/2002 Callendar et al. ..... 206/486

FOREIGN PATENT DOCUMENTS

GB 2188032 A * 9/1987

* cited by examiner

*Primary Examiner*—Gary E. Elkins
(74) *Attorney, Agent, or Firm*—Wolf Block Schorr & Solis-Cohen LLP

(57) ABSTRACT

A display carton including a corrugated board assembly having an initial flat unassembled state and an assembled state and a clear front wall having an initial flat unassembled state and an assembled state. The corrugated board assembly is structured and arranged in its assembled state to receive and retain the clear front wall.

15 Claims, 4 Drawing Sheets

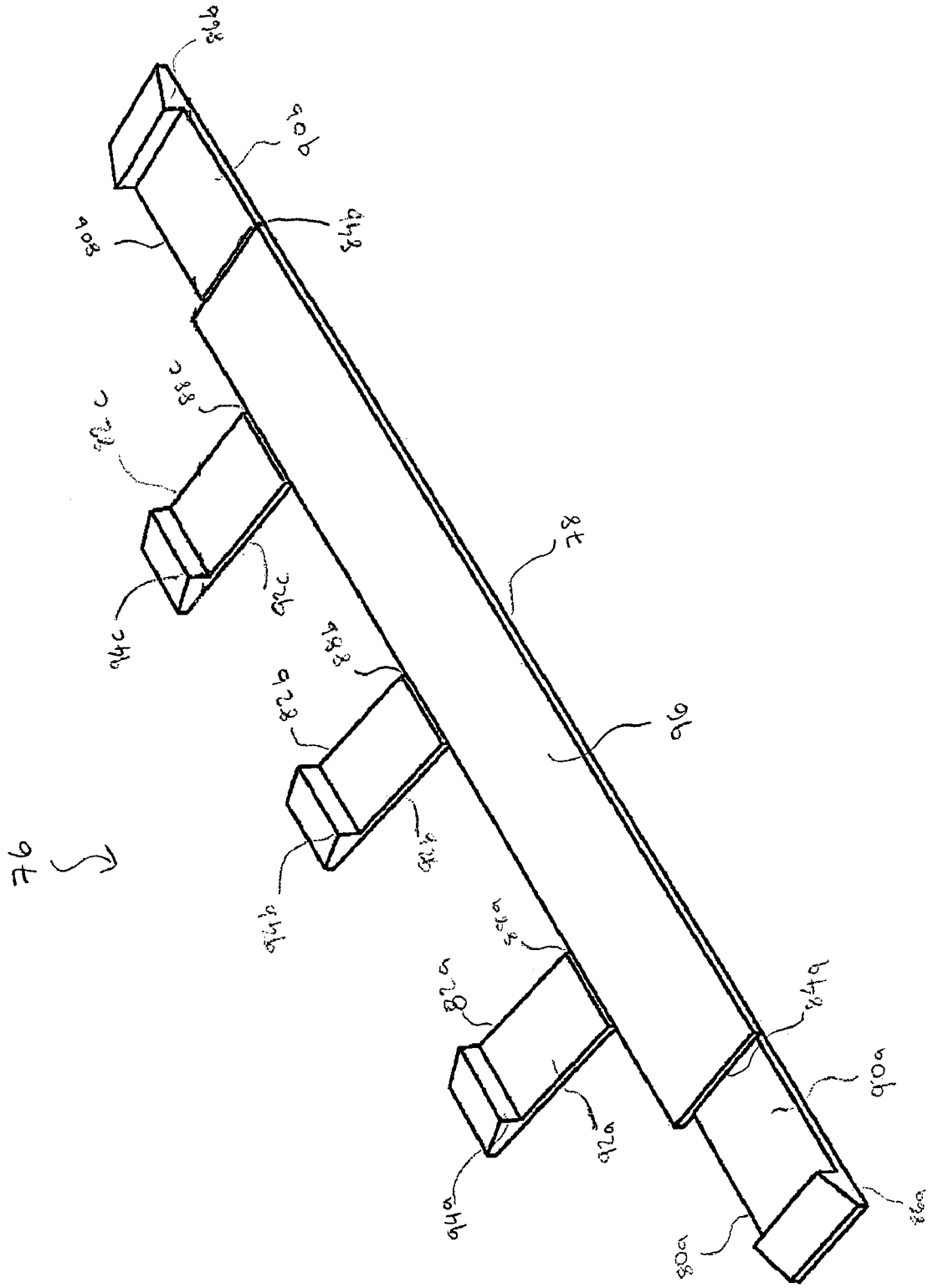
92
90b
92b
90a
94a
94b
92a
92b
94a
94b
92a
92b
94a
94b
92a
92b

POINT OF PURCHASE DISPLAY CARTON

CROSS-REFERENCE TO RELATED APPLICATIONS

This application claims the benefit of U.S. Provisional Application No. 60/458,725, filed Mar. 28, 2003.

FIELD OF THE INVENTION

The present invention relates to a point of purchase display carton constructed from a corrugated board that is foldable from an initially flat state to an assembled state for use. More particularly, the present invention relates to point of purchase display that is constructed from a corrugated board structured and arranged such that when in its assembled state it is adapted to receive and retain a clear plastic front panel so that the items displayed in the carton can be easily viewed by the purchaser.

BACKGROUND OF THE INVENTION

Display structures, racks and cartons formed from corrugated board are widely used in retail establishments for displaying merchandise. The corrugated boards used to form the display structures, racks and cartons are typically die cut from corrugated board and are foldable from an initially flat state to an assembled state for use.

One particular corrugated board display carton commonly used in the art is what is common known as a corrugated "PDQ" display carton. Display cartons of this type are adapted to contain a plurality of "impulse" type items such as bottles of aspirin, candy, gum or the like. PDQ display cartons generally comprise, in their assembled state, a bottom wall, a pair of opposed side walls, a front wall and a rear wall. The top of the display carton is open and the front wall of the display carton is normally of a height that is considerably less than a height of the rear wall of the carton. In this manner, a customer can view the products contained within the display carton and access the products from the front of the display carton to thereby remove one of the plurality of products for purchase. Often, the wholesaler or manufacturer will ship the display carton to a retailer in its assembled state with the products preloaded in the carton. When the display carton is shipped in this manner a shrink fit piece of cellophane or the like is wrapped around the display carton to maintain the products securely in the carton during shipping. Once the display carton and products arrive at the retail establishment, the retailer can simply remove the cellophane and place the display carton on a shelf or the like for sale of the products. Often, at the retail establishment, the display cartons are placed on a specifically designed rack for holding a plurality of PDQ display cartons.

Display cartons of the type described above have a number of benefits. First, since the display cartons are constructed from corrugated board, they are inexpensive which enables the retailer to simply discard the display carton once all of the products contained in the display carton have been sold. Also, from the perspective of the manufacturer, the display cartons are inexpensive and durable thereby helping maintain manufacturing and shipping costs at a minimum. In addition, the display cartons may be shipped and displayed in the same carton thereby also minimizing costs.

Although known display cartons have numerous advantages, as discussed above, they do have one major disadvantage. Specifically, since the these display cartons are normally constructed entirely from corrugated cardboard the front wall of the display is opaque which can obstruct the consumer's view of the products contained within the display carton. This disadvantage is particularly troublesome when the products contained within display carton do not have a height sufficient to extend significantly above the top edge of the front wall of the display carton, the front wall thereby preventing the consumer from easily viewing the product. This disadvantage is also particularly troublesome when the products are arranged in a stacked configuration in the display and a sufficient number of products have been sold such that the front wall blocks the consumer from viewing the remainder of the products in the display carton.

OBJECTS AND SUMMARY OF THE INVENTION

In view of the forgoing it is an object of the present invention to provide and improved display carton that overcomes the shortcomings of the display cartons disclosed in the prior art.

It is another object of the present invention to provide a display carton that can be easily folded from an initially flat state to an assembled state for use.

It is a yet another object of the present invention to provide a display carton that is inexpensive to manufacture.

It is a further object of the present invention to provide a display carton that enables a consumer to easily view the products contained within the display carton at all times regardless of the height of the products contained within the display carton and/or the number of products remaining in the display carton.

In accordance with the above objectives, the display carton according to the present invention includes a corrugated board assembly having an initial flat unassembled state and an assembled state, a clear front wall having an initial flat unassembled state and an assembled state, the corrugated board assembly being structured and arranged in its assembled state to receive and retain the clear front wall.

BRIEF DESCRIPTION OF THE DRAWINGS

A more complete appreciation of the present invention and many of the attendant advantages thereof will be readily understood by reference to the following detailed description when taken in conjunction with the accompanying drawings, in which:

FIG. 3 is a perspective view of the clear plastic front panel in its initial flat state;

DETAILED DESCRIPTION OF THE INVENTION

Figure 1:
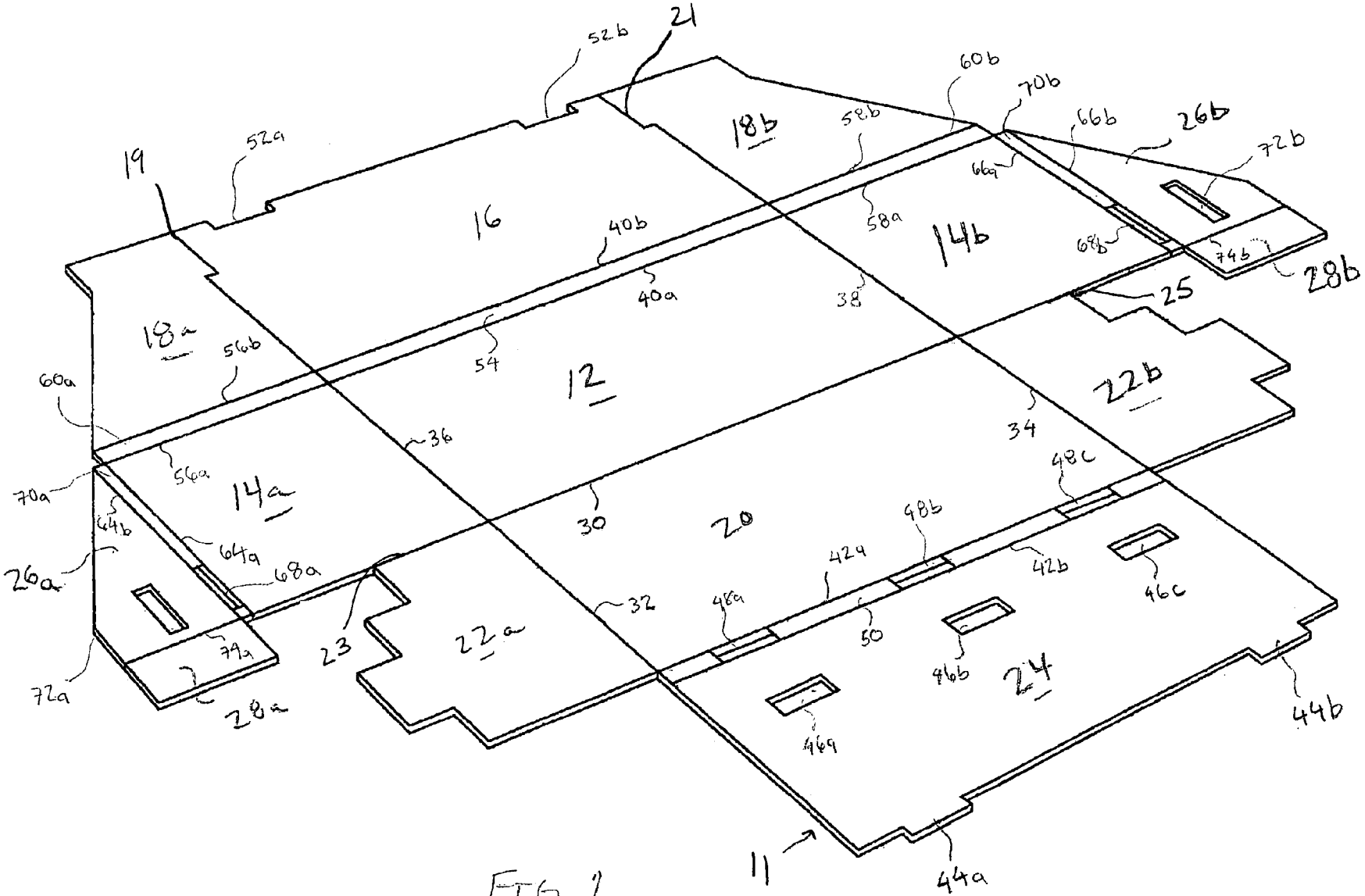
FIG. 1 is an elevational view showing the corrugated boar assembly in its initial flat unassembled state.

Referring now to the FIGS. 1-4 in which like reference characters designate identical or corresponding parts throughout the several views, the display carton in accordance with the present invention is identified generally by the reference numeral 10. The display carton includes a corrugated board assembly 11 and a clear plastic front panel 76.

Figure 4:
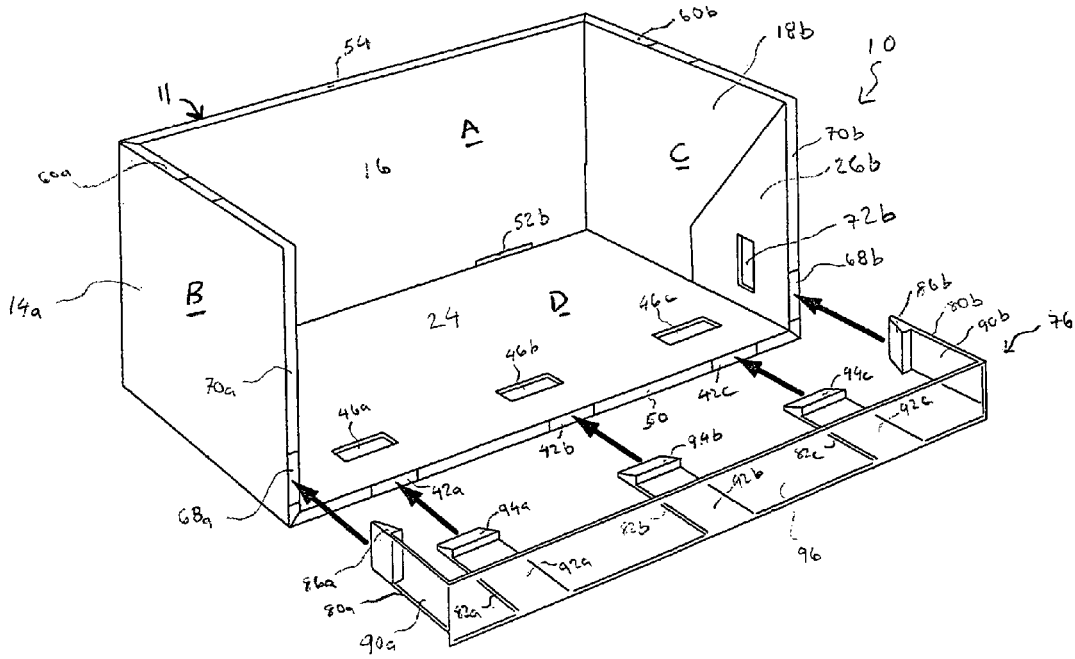
FIG. 4 is a perspective view of the display carton showing how the a clear plastic front panel is joined to the front of the corrugated board assembly.

The corrugated board assembly 11 is foldable from an initially flat state shown in FIG. 1 to an assembled state shown in FIG. 4. In its assembled state, the corrugated board assembly 11 defines a rear wall A, opposed side walls B and C and a bottom wall D. The front portion of the corrugated board assembly 11 in its assembled state is open. The front portion of the corrugated board assembly 11, as will be described in greater detail below, is structured and arranged to receive and retain the plastic front panel 76 such that the clear plastic front panel 76 defines the front wall of the display carton 10.

Reference is now made to FIG. 1 which shows the corrugated board assembly 11 in its initially flat state. The corrugated board assembly 11 generally comprises a unitary corrugated board having a plurality of sections or portions separated from one another by a plurality of fold lines that facilitate the assembly of the display carton from the flat state shown in FIG. 1 to the assembled state shown in FIG. 4. The various sections and fold lines will now be identified with reference to FIG. 1.

Corrugated board assembly 11 includes a first back wall panel 12 and a second back wall panel 16 which are separated from one another by a top edge section 54 defined between fold lines 40*a* and 40*b*. The second back wall panel 16 defines rectangular shaped notches 52*a* and 52*b*.

Located adjacent to the second back wall panel 16 is a first top side wall panel 18*a* and a second top side wall panel 18*b*. The first and second top side wall panels 18*a* and 18*b* are each separated from the second back wall panel 16 along respective cut lines 19 and 21.

Arranged adjacently to the first back wall panel 12 is a first side wall panel 14*a* and a second side wall panel 14*b*. A fold line 36 is defined between the first side wall panel 14*a* and the first back wall panel 12 and another fold line 38 is defined the second side wall panel 14*b* and the first back wall panel 12.

Interposed between the first side wall panel 14*a* and the first top side wall panel 18*a* is a first top sidewall edge section 60*a* defined between fold lines 56*a* and 56*b*. Interposed between the second side wall panel 14*b* and the second top side wall panel 18*b* is a second top sidewall edge section 60*b* defined between fold lines 58*a* and 58*b*.

A first slotted flap 26*a* is arranged adjacent to the first side wall panel 14*a*. Interposed between the first side wall panel 14*a* and the first slotted flap 26*a* is first sidewall edge section 70*a* defined between fold lines 64*a* and 64*b*. The first side edge section 70*a* also includes a first sidewall slit 68*a*. The first slotted flap 26*a* defines a first sidewall slot 72*a*. Arranged adjacent to the first slotted flap 26*a* is a first sidewall flap 28*a*, the first slotted flap 26*a* and first sidewall flap 28 being separated by a fold line 74*a*.

A second slotted flap 26*b* is arranged adjacent to the second side wall panel 14*b*. Interposed between the second side wall panel 14*b* and the second slotted flap 26*b* is second sidewall edge section 70*b* defined between crease lines 66*a* and 66*b*. The second side edge section 70*b* also includes a second sidewall slit 68*b*. The second slotted flap 26*b* defines a second sidewall slot 72*b*. Arranged adjacent to the second slotted flap 26*b* is a second sidewall flap 28*b*, the second slotted flap 26*b* and second sidewall flap 28*b* being separated by a fold line 74*b*.

Arranged adjacent to first back wall panel 12 is first bottom panel 20. A fold line 30 is defined between first back wall panel 12 and first bottom panel 20. Located adjacently on either side of first bottom panel 20 is a first and second bottom flap, 22*a* and 22*b*. Fold lines 32 and 34 are defined between first bottom flap 22*a* and the first bottom panel 20 and between second bottom flap 22*b* and the first bottom panel 20. A portion of first bottom flap 22*a* abuts the first sidewall panel 14*a* along a cut line 23 and a portion of the second bottom flap 22*b* abuts the second sidewall panel 14*b* along cut line 25.

A second bottom panel 24 is arranged adjacent to the first bottom panel 20. Interposed between the first bottom panel 20 and second bottom panel 24 is a front edge section 50. Fold lines 42*a* and 42*b* are defined between the front edge section 50 and the first bottom panel 20 and the front edge section 50 and the second bottom panel 24. Front edge section 50 defines slits 48*a*, 48*b* and 48*c*. Second bottom panel 24 defines locking slots 46*a*, 46*b* and 46*c*. The second bottom panel 24 also includes tabs 44*a* and 44*b*.

The structure of the clear plastic front panel 76 in its initial flat unassembled state will now be described with reference to FIG. 3. The clear plastic front panel 76 comprises a center portion 78. The center portion 78 includes a an inner surface 96 and an outer surface 98. The center portion 78 is connected to a first end locking tab 80*a* via crease line 84*a* and to a second end locking tab 80*b* via crease line 84*b*. The crease lines or living hinge, as they are referred to in the industry, allow the clear plastic front panel to be manually bent at room temperature. The first end locking tab 80*a* includes an end latch portion 86*a* and a substantially flat portion 90*a*. The second end locking tab 80*b* includes an end latch portion 86*b* and a substantially flat portion 90*b*. The a center portion 78 is also connected to center locking tabs 82*a*, 82*b* and 82*c* by crease lines 88*a*, 88*b* and 88*c* respectively. Center locking tab 82*a* includes a center latch portion 94*a* and a substantially flat portion 92*a*. Center locking tab 82*b* includes a center latch portion 94*b* and a substantially flat portion 92*b*. Center locking tab 82*c* includes a center latch portion 94*c* and a substantially flat portion 92*c*. The clear plastic front panel 76 is preferably constructed from polyethylene terephtalate modified with cyclohexanedimethanol (PETG). The use of PETG is preferably since it may be manually bent along the crease lines at room temperature and does not require any heating of the clear plastic front panel 76 or an additional tool or device to bend the locking tabs. However, it is possible that the clear plastic front panel 76 could be constructed from other suitable clear materials. The PETG clear plastic front panel 76 is manufactured in its initial flat state by an injection molding process.

Figure 2:
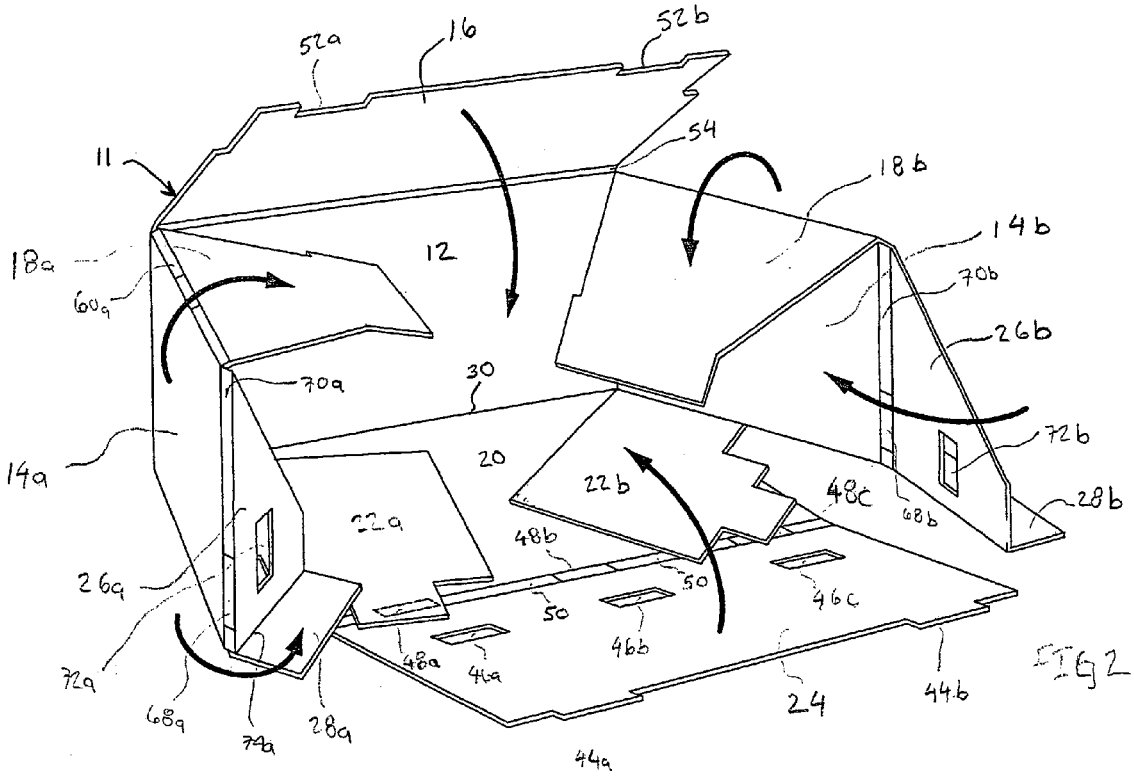
FIG. 2 is a perspective view of the display carton depicting corrugated board assembly is folded from its initial flat unassembled state to its assembled state.

Referring now to FIG. 2, the assembly of the corrugated board assembly 11 from its flat initial state shown in FIG. 1 to its assembled state shown in FIG. 4 will now be described. The first bottom flap 22*a* and the second bottom flap 22*b* are each adapted to be folded inwardly along fold line 32 and along fold line 34 respectively. Next, the first backwall panel 12 is folded towards the an interior of the display carton 10 along fold line 30 to form a right angle with the first bottom panel 20.

Then the first sidewall panel 14*a* and the second sidewall panel 14*b* are folded towards the interior of the display carton 10 so as to form a right angles with the first backwall panel 12. The first sidewall panel 14*a* is folded up towards the interior of the display carton 10 along the fold line of 36 and the second sidewall panel 14*b* is folded up towards the interior along the fold line 38.

Then the first top sidewall panel 18*a* is folded over, along fold lines 56*a* and 56*b*, in contact with the first sidewall panel 14*a* thereby forming a first top sidewall edge section 60*a*. The first slotted flap 26*a* is then folded, along fold lines 64*a* and 64*b*, thereby forming a first sidewall edge section 70*a*. Similarly, the second top sidewall panel 18*b* is folded over, along fold lines 58*a* and 58*b*, thereby forming a second top sidewall edge section 60*b*. The second slotted flap 26*b* is then folded, along lines 66*a* and 66*b*, thereby forming a second sidewall edge section 70*b*.

The first sidewall flap 28*a* is folded along fold line 74*a* to form a right angle with the first slotted flap 26*a* and is folded to be in contact with the first bottom flap 22*a*. The second sidewall flap 28*b* is folded along fold line 74*b* to form a right angle with the second slotted flap 26*b* and is folded to be in contact with the second bottom flap 22*b*.

The second bottom panel 24 is then folded along fold lines 42*a* and 42*b* towards the interior of the display carton 10 to be in contact with the first sidewall flap 28*a* and the second sidewall flap 28*b*. The second bottom panel 24 secures the first sidewall flap 28*a* to the floor of the display carton 10, thereby securing the first slotted flap 26*a* to the first top sidewall panel 18*a*, which secures the first top sidewall panel 18*a* to the first sidewall pane 14*a*. Similarly, the second bottom panel 24 secures the second sidewall flap 28*b* to the floor of the display carton 10, thereby securing the second slotted flap 26*b* to the second top sidewall panel 18*b*, which secures the second top sidewall panel 18*b* to the second sidewall panel 14*b*.

The second backwall panel 16 is then folded down to lock the second bottom panel 24 in place. The rectangular-shaped notches 52*a*, 52*b* of the second backwall panel 16 engage the tabs 44*a*, 44*b* of the second bottom panel 24 to lock the both the second backwall panel 16 and the second bottom panel 24 in place.

The assembly of the clear front plastic panel 76 front its flat initial state shown in FIG. 3 to its bent assembled state shown in FIG. 4 will now be described. The first end locking tab 80*a* is bent manually towards the inner surface 96 of the center portion 78, via crease line 84*a* so that the substantially flat portion thereof 90*a* is at a right angle with the inner surface 96 of the center portion 78 of the clear plastic front panel 76. The second end locking tab 80*b* is bent manually towards the inner surface 96 of the center portion 78, via crease line 84*b* so that the substantially flat portion thereof 90*b* is at a right angle with the inner surface 96 of the center portion 78 of the clear plastic front panel 76.

Similarly, each of the center locking tabs 82*a*, 82*b* and 82*c* is bent manually towards the inner surface 96 of the center portion 78, via crease lines 88*a*, 88*b* and 88*c* respectively, so that each of the substantially flat portions thereof 92*a*, 92*b*, 92*c* is at a right angle with the inner surface 96 of the center portion 78 of the clear plastic front panel 76.

Figure 5:
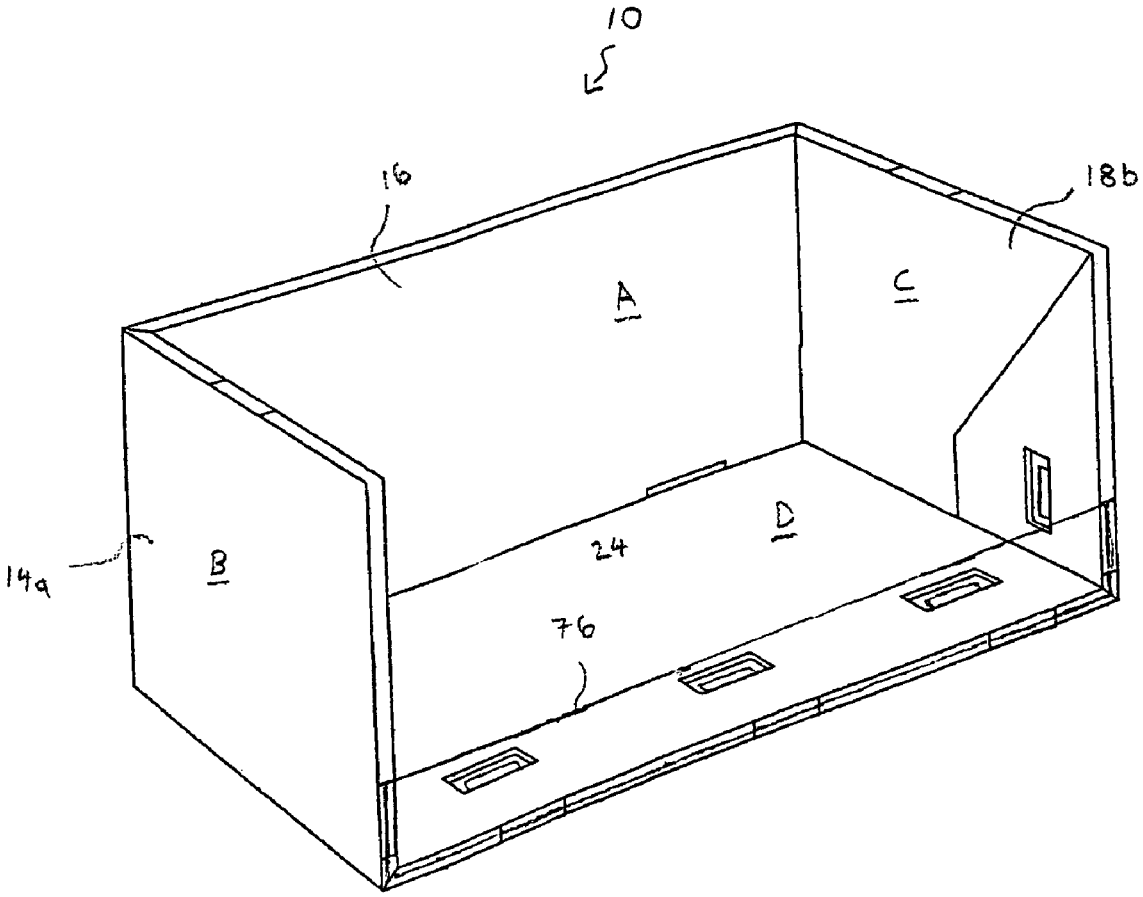
FIG. 5 is a perspective view of the display carton according to the present invention its final assembled state.

After each of the corrugated board assembly 11 and the clear plastic front panel 76 are individually assembled in the manner described above, the clear plastic front panel 76 is inserted into the corrugated board assembly 11 as shown in FIG. 4 to thereby form the completed display carton 10 as shown in FIG. 5. The clear plastic front panel 76 is inserted into the corrugated board assembly 11 as follows. The first end locking tab 80*a* and the second end locking tab 80*b* are pushed through the first sidewall slit 68*a* and the second sidewall slit 68*b*, respectively. While also at the same time, the center locking tabs 82*a*, 82*b* and 82*c* are pushed through slits 48*a*, 48*b*, and 48*c* respectively. The latch portions of the locking tabs spread the various slits open until the locking tabs find relief in the slots. At this point the locking tabs are secured to the front end of the display carton.

The embodiment of the present invention described above overcomes the shortcomings and problems inherent in prior art point of purchase display cartons and provides additional advantages and benefits. Specifically, the present invention provides a display carton that includes a clear plastic front panel that enables a consumer to easily view the products, at all times, contained within the display carton, while at the same time allowing for the ease of shipping a vast number of unassembled display cartons. Both the corrugated panel and the clear plastic front panel are manufactured in a flat unassembled state thereby permitting stacking of both a plurality of corrugated panels and a plurality of clear plastic front panels during shipment. Once the display cartons are received from the manufacturer, the wholesaler may easily assemble each display carton so that is may be filled with product before shipment to the retailer.

Although exemplary embodiments of the present invention has been shown and described, it will be apparent to those having ordinary skill in the art that a number of changes, modifications or alterations may be made, none of which depart from the spirit of the present invention. All such changes, modifications or alterations should therefore be seen as within the scope of the present invention.

The invention claimed is:

1. A display carton comprising:

a corrugated board assembly having an initial flat unassembled state and an assembled state, wherein said corrugated board assembly in its assembled state defines a bottom wall and at least one vertical wall, wherein said bottom wall and said at least one vertical wall define an interior of said display carton, and wherein at least one of said bottom wall and said at least one vertical wall have at least one slit for receiving a locking tab;

a clear front wall having at least one locking tab which corresponds to said at least one slit;

wherein said clear front wall comprises a center portion a plurality of locking tabs extending from said center portion, a crease line being defined between each of said locking tabs and said center portion for facilitating the folding of each of said locking tabs from said initial flat state to said assembled state of said clear front wall;

wherein one of said plurality of locking tabs is a first end locking tab extending from said first end of said center portion and another one of said plurality of locking tabs is a second end locking tab extending from said second end of said center portion; and wherein said plurality of locking tabs includes a plurality of center locking tabs each of which extends from a side of said center portion; and wherein said at least one slit of said corrugated board assembly is structured and arranged when said corrugated board assembly is in its assembled state to receive and retain said at least one locking tab of said clear front wall.

2. The display carton according to claim 1, wherein said corrugated board assembly in its assembled state defines a bottom wall, a back wall and two opposed side walls, said bottom wall, back wall and opposed side walls defining an interior of said display carton for holding at least one product.

3. The display carton according to claim 2, wherein a height of said clear front wall is less than a height of each of said back wall and opposed side walls.

4. The display carton according to claim 1, wherein each of said at least one locking tabs has a latch portion structured and arranged to be received and retained within a corresponding slot defined in said corrugated board assembly in its assembled state.

5. The display carton according to claim 1, wherein each of said locking tabs includes a latch portion structured and arranged to be received and retained within a corresponding slot defined in said corrugated board assembly in its assembled state.

6. The display carton according to claim 1, wherein said clear front wall has an initial flat unassembled state and an assembled state.

7. The display carton according to claim 6, wherein said clear front panel is constructed from a material that is foldable from said initial flat unassembled state to said assembled state at room temperature.

8. The display carton according to claim 7, wherein said clear front panel is constructed from a plastic material.

9. The display carton according to claim 7, wherein said clear front panel is constructed from PETG.

10. The display carton according to claim 6, wherein said clear front panel comprises:

a plurality of locking tabs, wherein when said clear front panel is in its assembled state said plurality of locking tabs are structured and arranged to be received and retained by said corrugated board assembly in its assembled state.

11. The display carton according to claim 6, wherein said clear front panel comprises:

a center portion;

a plurality of locking tab extending from said center portion;

wherein said center portion has a first and second end;

wherein one of said plurality of locking tabs is a first end locking tab extending from said first end of said center portion and another one of said plurality of locking tabs is a second end locking tab extending from said second end of said center portion; and wherein said plurality of locking tabs includes at least one center locking tab which extends from a side of said center portion.

12. A merchandise display carton made of corrugated board having an initial flat unassembled state and an assembled state, comprising:

a bottom wall, a rear wall , and opposing side walls defining an interior of said display carton for holding at least one product, said display carton having a top opening at the top of said carton and a front opening at the front of said carton;

a clear front lip coupled to the front of said display carton when said display carton is in its assembled state at the bottom of said front opening to retain product within said display carton without obstructing a consumer's view of the product, wherein said clear front lip is shorter than said opposing side walls such that product can be placed within and removed from said display carton without removing said clear front lip.

13. The display canon of claim 12, wherein said clear front lip is removably coupled to said display carton.

14. The display carton of claim 12, wherein said clear front lip comprises a plurality of locking tabs that correspond to slits in said display carton, whereby said locking tabs are received and retained in said slits.

15. The display carton of claim 12, wherein said clear front lip is less than half the height of said opposing walls.

* * * * *